United States Patent [19]

Shigenobu

[11] Patent Number: 4,594,975

[45] Date of Patent: Jun. 17, 1986

[54] GLOW PLUG CURRENT SUPPLY CONTROL SYSTEM

[75] Inventor: Hiromichi Shigenobu, Toyota, Japan

[73] Assignee: Toyota Jidosha Kabushiki Kaisha, Toyota, Japan

[21] Appl. No.: 761,335

[22] Filed: Jul. 31, 1985

Related U.S. Application Data

[63] Continuation of Ser. No. 575,682, Jan. 31, 1984, abandoned.

[30] Foreign Application Priority Data

Feb. 2, 1983 [JP] Japan ..... 58-15770

[51] Int. Cl.[4] ..... F02N 17/00

[52] U.S. Cl. ..... 123/179 H; 123/145 A; 123/179 B

[58] Field of Search ..... 123/179 H, 179 B, 179 BG, 123/145 A; 219/497, 508, 509, 494

[56] References Cited

U.S. PATENT DOCUMENTS

| | | | |
|---|---|---|---|
| 4,088,109 | 5/1978 | Woodruff et al. | 123/179 H |
| 4,307,688 | 12/1981 | Steele | 123/179 H |
| 4,307,689 | 12/1981 | Raeske et al. | 123/179 H |
| 4,350,876 | 9/1982 | Kubota et al. | 219/497 |
| 4,391,237 | 7/1983 | Abe et al. | 123/145 A |
| 4,413,174 | 11/1983 | Ting | 123/179 H |
| 4,458,639 | 7/1984 | Abe et al. | 123/179 H |
| 4,504,732 | 3/1985 | Bube et al. | 123/179 H |

FOREIGN PATENT DOCUMENTS

| | | | |
|---|---|---|---|
| 0043223 | 3/1980 | Japan | 123/179 H |
| 0649874 | 5/1979 | U.S.S.R. | 123/179 B |

OTHER PUBLICATIONS

790208 Design of a Fast Start Glow Plug Control System for Diesel Engines A. R. Sundeen, Feb. 2, 1979, Society of Automotive Engineers, Inc.

*Primary Examiner*—Parshotam S. Lall

*Attorney, Agent, or Firm*—Cushman, Darby & Cushman

[57] ABSTRACT

A glow plug current supply control system for a diesel engine comprises a rapid heating circuit and an after glow circuit. A current can be supplied to a glow plug through either the rapid heating circuit or after glow circuit. When the after glow circuit is closed, the current is intermittently supplied to the glow plug through thyristor on-off operated by a signal from an oscillator circuit. Before the diesel engine starts, the current is supplied to the glow plug through the rapid heating circuit and after the diesel engine starts, the current is supplied to the glow plug through the after glow circuit.

5 Claims, 5 Drawing Figures

GLOW PLUG CURRENT SUPPLY CONTROL SYSTEM

This is a continuation, of application Ser. No. 575,682, filed Jan. 31, 1984, which was abandoned upon the filling hereof.

BACKGROUND OF THE INVENTION

This invention relates to a glow plug current supply control system in a diesel engine, and particularly to a glow plug current supply system having a rapid heating circuit and an after glow circuit.

In order to stabilize the combustion in the diesel engine in the cold state to control occurrence of white smoke and sounds of vibrations, there has been used an after glow circuit for supplying current not only during warming-up prior to the start of the engine but also after the start of engine. In this after glow current supply, if a voltage from a power source is directly applied to the glow plug, then the glow plug is heated to an undesired high temperature and the durability of the glow plug is lowered to a considerable extent. Consequently, a resistor is connected to the glow plug in series, so that the voltage applied to the glow plug can be decreased. However, this arrangement is disadvantageous in that an electric power consumed in resistor is high and a resistor is heat to a high temperature. In consequence, when the above-described after glow circuit is provided with the diesel engine, consideration in the aspect of safety is need thus possibly resulting in increased manufacturing cost.

SUMMARY OF THE INVENTION

It is one object of the present invention to provide an improved glow plug current control system for reducing current supply to a glow plug without using a resistor causing a power consumption.

It is another object of the present invention to provide an improved system for intermittently supplying a current to the glow plug by on-off operating a second switching element in an after glow current supply.

It is a still another object of the present invention to provide an improved system for terminating an after glow current supply, in which current intermittently supplies to the glow plug by on-off operating the second switching element, by using a timing circuit.

It is a further object of the present invention to provide an improved system in which current to a glow plug is intermittently supplied to the glow plug by on-off operating a second switching element in an after glow current supply, temperature of a glow plug is discriminated in a rapid heating before a diesel engine is started and the temperature of the glow plug is maintained within a predetermined range by on-off operating a first switching element.

It is still a further object of the present invention to provide an improved system in which current to a glow plug is intermittently supplied to the glow plug by on-off operating a second switching element in an after glow current supply, an after glow current supply is terminated by using a timing circuit, temperature of a glow plug is discriminated in a rapid heating before a diesel engine is started and the temperature of the glow plug is maintained within a predetermined range by on-off operating a first switching element.

According to the present invention, in the after glow current supply after the rapid heating, the generated voltages are intermittently supplied to the glow plug through switching elements, whereby there is no electric power which would otherwise be consumed as in the conventional system, so that power consumption may be minimized.

In the embodiment of the present invention, semiconductors are used as the switching elements, so that not only the reliability may be improved but also working sounds due to on-off operation of the contact points may be prevented from occurring. Furthermore, in the case of applying the three phase AC voltages from the alternator to the glow plug through the thyristors, necessity for the extinction circuits of the thyristors, which are necessitated in the case of applying the direct current from a generator to the glow plug through the thyristors can be eliminated, and comparing with in the case of intermittently applying the direct current voltage from the generator to the glow plug through the transistors, the semiconductors can be prevented from becoming large-sized, thus enabling to render the system compact in size.

DESCRIPTION OF THE PREFERRED EMBODIMENT

Figure 1:
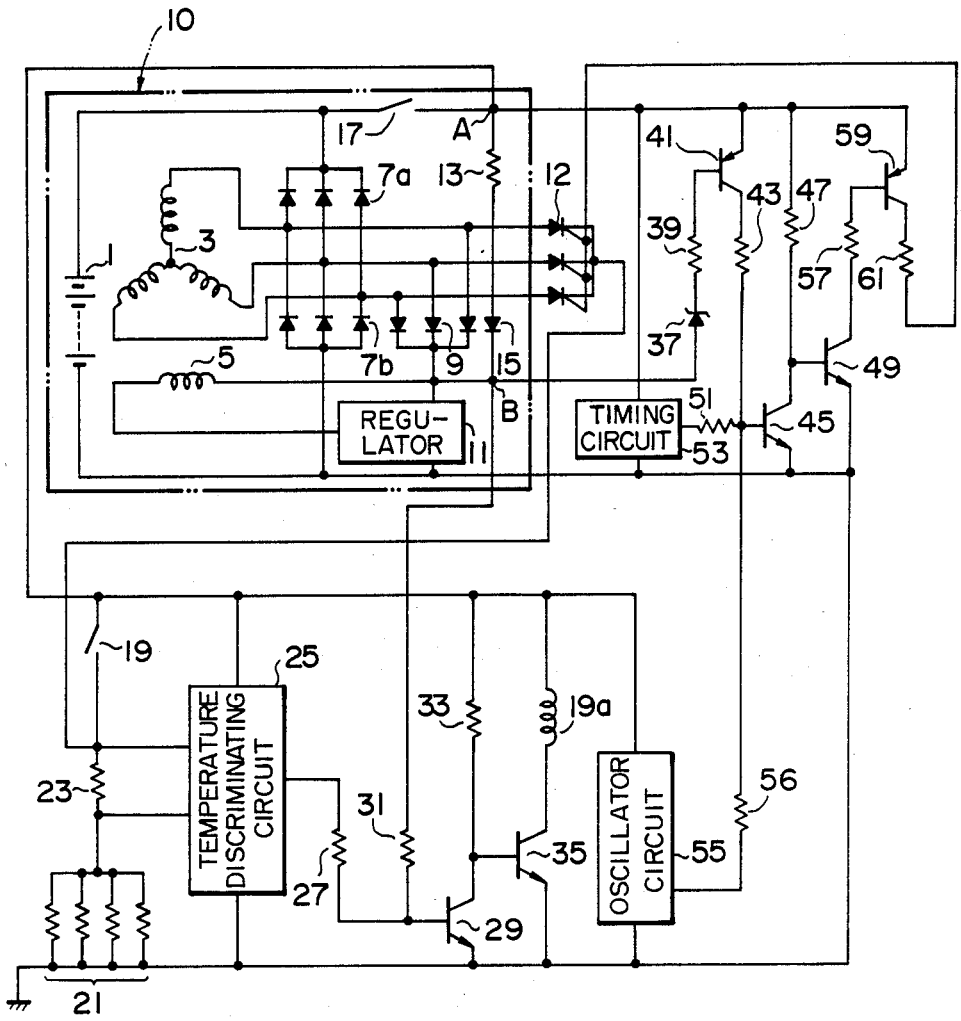
FIG. 1 is a circuit diagram showing one embodiment of the present invention.

FIG. 1 shows a detailed circuit diagram of this system, in which reference numeral 1 denotes a battery, 3 a Y-connected armature coil of an alternator used as a generator for a motor vehicle, 5 an exciting coil thereof, *7a* and *7b* groups of diodes for the full-wave rectification, and 9 a group of diodes for the auxiliary rectification, through which current is supplied to the exciting coil 5. Reference numeral 11 is a voltage regulator, 13 a resistor, 15 a diode, and 17 a key switch, all of which constitute a power circuit 10 commonly used for a motor vehicle.

Designated at 12 is a group of thyristors as being switching elements, which are connected to the diodes *7b* and the armature coil 3, in the same manner as the diodes *7a* and the diodes 9, so as to constitute a full-wave rectifier circuit.

Figure 3:
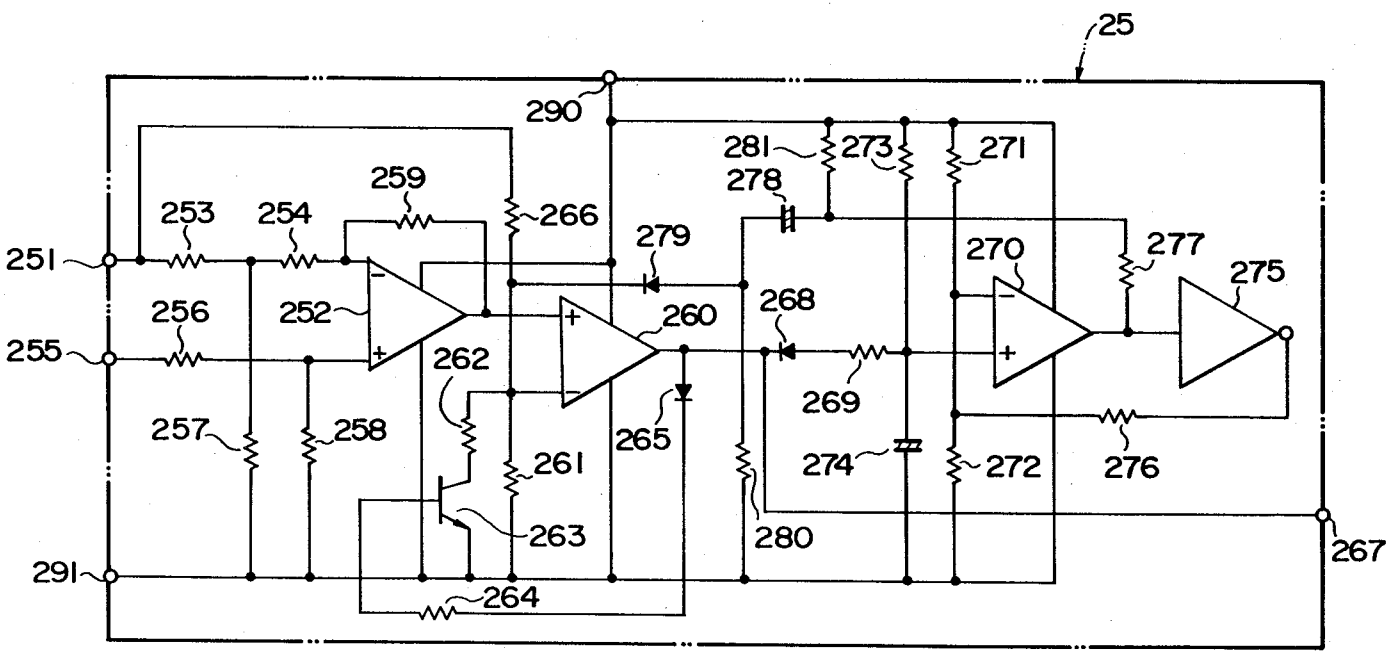
FIG. 3 is a circuit diagram showing the detailed example of the temperature discriminating circuit illustrated in FIG. 1.

Denoted at 19 is a relay contact being interposed between a power circuit 10 and a glow plug 21. A resistor 23 for detecting a current is interposed between the relay contact 19 and the glow plug 21. The resistor 23 is considerably low in the resistance valve. Cathodes of the group of thyristors 12 are connected to the glow plug 21 through the resistor 23. Designated at 25 is a temperature discriminating circuit for discriminating whether the temperature of the glow plug 21 reaches a predetermined value due to a voltage drop occurring in the resistor 23. An output from the temperature discriminating circuit 25 is on the low level when the glow plug 21 is low in temperature, inverted to the high level when the temperature reaches the predetermined value, and inverted again to the low level after a predetermined period of time, e.g., two sec. has elapsed. An example of the temperature discriminating circuit 25 is shown in FIG. 3.

An output from the temperature discriminating circuit 25 is connected to a base of a transistor 29 through a resistor 27. The base of the transistor 29 is connected to a point B of the power circuit 10 through a resistor 31. The collector of the transistor 29 is connected to a point A of the power circuit 10 through a resistor 33, connected to a base of a transistor 35. The emitter of the transistor 29 is grounded. The base of the transistor 35 is connected to the point A of the power circuit 10 through the resistor 33, the collector thereof is connected to the point A of the power circuit 10 through a relay coil 19*a*, and the emitter thereof is grounded.

The point B of the power circuit 10 is further connected to a base of a transistor 41 through a Zener diode 37 and a resistor 39, which are connected to each other in series. The collector of the transistor 41 is connected to a base of a transistor 45 through a resistor 43 and the emitter thereof is connected to the point A of the power circuit 10. The collector of the transistor 45 is connected to the point A of the power circuit 10 through a resistor 47, and connected to a base of a transistor 49. The base of the transistor 45 is connected to an output terminal of a timing circuit 53 through a resistor 51, and further, connected to an output terminal of an oscillator circuit 55 through a resistor 56. The collector of the transistor 49 is connected to a base of a transistor 59 through a resistor 57, and the emitter thereof is grounded. The collector of the transistor 59 is connected to control terminals (gates) of the group of thyristors 12 through a resistor 61, and the emitter thereof is connected to the point A of the power circuit 10.

An output signal from the timing circuit 53 comes to be on the low level in response to the turn-on of the key switch 17, and is inverted to be on the high level after a predetermined period of time has elapsed. The oscillator circuit 55 is adapted to start to oscillate in response to the turn-on of the key switch 17.

Description will hereunder be given of an operation of the system having the above-described arrangement.

When the key switch 17 is turned on, an initial exciting current flows through the resistor 13 and diode 15 to the exciting coil 5 and voltage regulator 11. However, the stopped engine does not permit the alternator to generate. In consequence, a voltage at the point B of the power circuit 10 indicates a voltage determined by the resistor 13 (about several tens Ω), doide 15, exciting coil 5 (about 3Ω) and voltage regulator 11. The voltage thus determined is relatively low.

Since the voltage at the point B is smaller than the voltage of the battery in this condition, the base current of the transistor 41 flows through the resistor 39 and the Zener diode 37, so that the transistor 41 is brought into the conducted state. In consequence, current flows to the base of the transistor 45 through the transistor 41 and the resistor 43, so that the transistor 45 is brought into the conducted state. When the transistor 45 is brought into the conducted state, no current flows through the base of the transistor 49, which is brought into the non-conductive state, and no current flows through the resistor 57 connected to the base of the transistor 59, whereby the transistor 59 is brought into the non-conductive state as well. In consequence, no current flows through the gates of the group of thyristors 12, which remain in the non-conductive state.

The oscillator circuit 55 starts to oscillate in response to the turn-on of the key switch 17, and pulse signals periodically repeating to be on the high level or the low level appear at the output terminal of the oscillator circuit 55. However, since the transistor 45 is held in the conducted state as described above, the pulse signals from the oscillator circuit 55 do not affect the conducted state or non-conductive state of the transistor 45. Furthermore, although the timing circuit 53 starts to perform the timing operation in response to the turn-on of the key switch 17, signal of the low level appears at the output terminal of the timing circuit 53 until a predetermined period of time elapse. Thus, the timing circuit 53 does not affect the conducted state or non-conductive state of the transistor 45 similarly to the above.

Likewise, when the key switch 17 is turned on, an output from the temperature discriminating circuit 25 comes to be on the low level and no current flows through the resistor 27, whereby the transistor 29 falls into the non-conductive state. Then, the base current flows to the transistor 35 through the resistor 33, so that the transistor 35 is brought into the conducted state and resulting in the excited relay coil 19*a*. The excitation of the relay coil 19*a* causes the relay contact 19 to be closed to form the rapid heating circuit, so that current can flow through the resistor 23 to the glow plug 21. Since the resistor 23 is considerably low in the resistance value, a high current flows through the glow plug 21, and the temperature is rapidly raised.

The higher the temperature of the glow plug 21 is, the higher the resistance value thereof becomes, and then the current therethrough is reduced, whereby the voltage drop of the resistor 23 is reduced. When the temperature of the glow plug 21 is raised to a predetermined value, that is, the voltage drop of the resistor 23 is lowered to a predetermined value, an output from the temperature discriminating circuit 25 is inverted to be on a high level. When the output from the temperature discriminating circuit 25 comes to be on the high level, the current flows to the base of the transistor 29 through the resistor 27, whereby the transistor 29 is brought into a conducted state. When the transistor 29 is in the conducted state, the current, which has been flowed to the base of the transistor 35 through the resistor 33, flows to the transistor 29, and thus the transistor 35 is brought into the non-conductive state. This causes the relay coil 19*a* to be demagnetized to open the relay contact 19, whereby no current flows to the glow plug 21 and then the temperature of the glow plug 21 starts to be lowered. Since an output from the temperature discriminator circuit 25 comes to be on the low level in a predetermined period of time, the current, which has flowed to the transistor 29 through the resistor 27, does not flow, and, the transistor 29 is brought into the non-conductive state and the transistor 35 into the conducted state by the action contrary to the above. In consequence, the relay coil 19*a* is excited again, so that the relay contact 19 is closed. In response to closing the relay contact 19, current flows through the glow plug 21, and then the temperature of the glow plug 21 starts to be raised.

Through the repetition of the above-described actions, the temperature of the glow plug 21 in the preheating stage before a starter is driven can be held within a predetermined range.

When the starter is driven to start the engine upon completion of preheating of the glow plug 21, a rotor of the alternator having the exciting coil 5 starts to rotate. At this time, the initial exciting current flows to the voltage regulator 11 through the resistor 13, the diode 15 and the exciting coil 5, whereby the alternator starts to generate. A voltage thus generated is rectified by the diodes 7a and 9 and appears at the point B. When the voltage at the point B is increased with the rise of the rotational speed of the engine, the current flowing through the exciting coil 5 increases. This causes the voltage generated by the alternator, i.e., the voltage at the point B to increase again. Through the repetition of the above-described actions, the voltage abruptly increases. When the electric potential at the point B becomes higher than the electric potential of the battery, current flows out of the diode 7a. When the voltage at the point B becomes higher than the voltage determined by the Zener diode 37, the base current, which has flowed through the resistor 39 and Zener diode 37, does not flow, whereby the transistor 41 is brought into the non-conductive state. In consequence, the base current, which has flowed to the transistor 45 through the resistor 43, does not flow, whereby the transistor 45 is brought into the non-conductive state.

When the transistor 45 is brought into the nonconductive state, current flows to the transistor 49 through the resistor 47 and the transistor 49 is brought into the conducted state. The base current of the transistor 59 flows through the resistor 57 in response to turning on the transistor 49, so that transistor 59 is brought into the conducted state as well. When the transistor 59 is brought into the conducted state, current flows to control terminals (gates) of the group of thyristors 12 through the resistor 61, whereby the group of thyristors 12 are brought into the conducted state to form an after glow circuit. In consequence, an after glow current can be caused to flow to the glow plug 21 through the resistor 23.

Even when temperature of the glow plug 21 is at a predetermined value or less and an output from the temperature discriminating circuit 25 is on the low level, if a voltage appears at the point B, current flows to the base of the transistor 29 through the resistor 31, whereby the transistor 29 is inverted into the conducted state. This causes the transistor 35 to be brought into the non-conductive state, so that the relay coil 19a is demagnetized to open the relay contact 19, to thereby form the after glow circuit. On the other hand, since outputs from the oscillator circuit 55 periodically repeat to be on the high or low level, the respective thyristors in the group of thyristors 12 periodically repeat the conducted state or non-conductive state as described above.

When the group of thyristors 12 are brought into the conducted state and a voltage is applied to the glow plug 21, the temperature of the glow plug 21 is raised. When the group of thyristors 12 are subjected to the extinction of arc in response to three-phase AC signals of the alternator and no voltage is applied to the glow plug 21, the temperature of the glow plug 21 is lowered. When the group of thyristors 12 is brought into the conducted state again in response to high level signals from the oscillator circuit 55, the temperature of the glow plug 21 is raised. In consequence, it becomes possible to raise the temperature of the glow plug 21 after the start of the engine to a predetermined value by suitably selecting the cycles of the conducted state and non-conductive state of the group of thyristors 12.

Figures 2A, 2B:
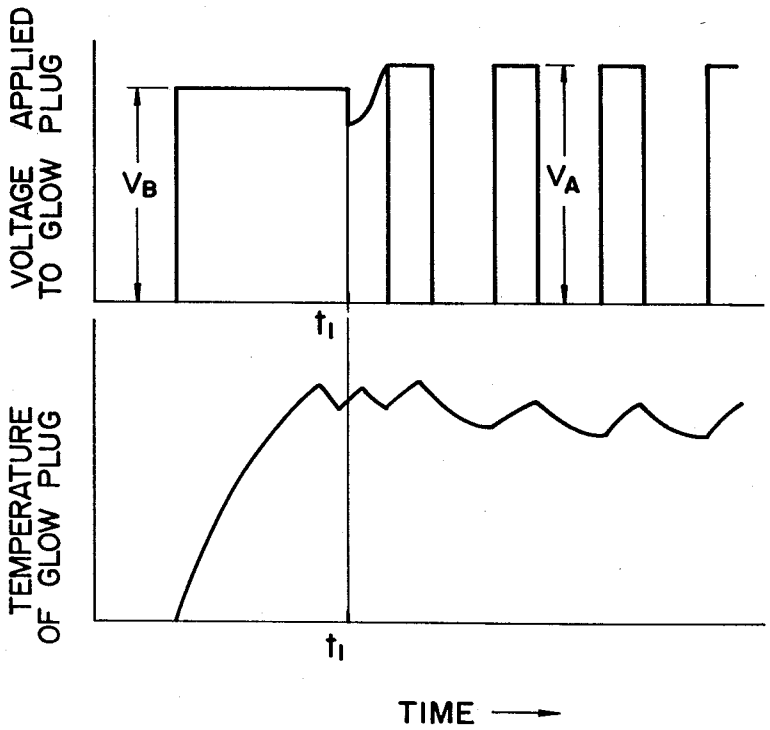
FIG. 2A is a waveform diagram showing the voltages applied to the glow plug.
FIG. 2B is a graphic chart showing the temperature characteristics of the glow plug.

FIGS. 2A and 2B show waveforms of voltages applied to the glow plug 21 through the control of the group of thyristors 12 as described above and the characteristics of the temperature rise in the glow plug, respectively. In FIG. 2A, $V_B$ indicates a battery voltage and $V_A$ an output from the alternator. If the starter is driven to start the engine at a time point $t_1$, the group of thyristors 12 are on-off operated at predetermined cycles as described above, whereby voltages are intermittently applied to the glow plug 21. In consequence, the temperature of the glow plug 21 can repeat the rise or fall as shown in FIG. 2B, thereby enabling to maintain the glow plug 21 within a predetermined temperature range.

When the time preset in the timing circuit 53 elapses after the turn-on of the key switch 17, the timing circuit 53 outputs high level signals, whereby the transistor 45 is brought into the conducted state, the transistor 49 into the non-conductive state state and the transistor 59 into the non-conductive state, so that the control of the after glow current supply by the group of thyristors 12 is terminated.

As described above, in the embodiment shown in FIG. 1, when the temperature of the glow plug 21 is at a predetermined value or less, if the key switch 17 is turned on, then the relay contact 19 is closed and a battery voltage is applied to the glow plug 21. When the temperature of the glow plug 21 exceeds a predetermined value, the relay contact 19 is opened in accordance with the operation of the temperature discriminating circuit 25, and the temperature of the glow plug 21 starts to be lowered. After a predetermined time elapses, the relay contact 19 is closed again by the operation of the temperature discriminating circuit 25, whereby the temperature of the glow plug 21 is raised again. Through the repetition of the actions as described above, during the preheating before the start of the engine, the temperature of the glow plug 21 can be maintained at a predetermined value after the rapid heating.

When the engine is started and the alternator begins to generate, the relay contact 19 is opened and the group of thyristors 12 are on-off operated at a predetermined cycle, so that the temperature of the glow plug 21 can be maintained in a predetermined range of temperature through the after glow current supply control.

Detailed description will hereunder be given of the temperature discriminating circuit 25 with reference to FIG. 3.

A first input terminal 251 of the temperature discriminating circuit 25 and an inverting input terminal of a first operational amplifier 252 are connected to each other through resistors 253 and 254. A second input terminal 255 and a non-inverting input terminal of the operational amplifier 252 are connected to each other through a resistor 256. The connected point between the resistors 253 and 254 is grounded through a resistor 257, and the non-inverting input terminal of the operational amplifier 252 is grounded through a resistor 258. An output terminal and the non-inverting input terminal of the operational amplifier 252 are connected to each other through a feedback resistor 259. The output terminal of the operational amplifier 252 is connected to a non-inverting input terminal of a second operational amplifier 260. A non-inverting input terminal of the second operational amplifier 260 is grounded through a resistor 261 and further grounded through a resistor 262 and a transistor 263. The base of the transistor 263 is connected to an output terminal of the operational amplifier 260 through a resistor 264 and a diode 265. The first input terminal 251 of the temperature discriminating circuit 25 and the non-inverting input terminal of the operational amplifier 260 are connected to each other through a resistor 266.

The output terminal of the operational amplifier 260 is connected to an output terminal 267 of the temperature discriminating circuit 25, and connected to a non-inverting input terminal of a third operational amplifier 270 through a diode 268 connected in a reverse direction and a resistor 269. An inverting input terminal of the third operational amplifier 270 is connected to a power source input terminal 290 through a resistor 271, and grounded through a resistor 272. The non-inverting input terminal of the operational amplifier 270 is connected to the power source input terminal 290 through a resistor 273, and grounded through a capacitor 274. An output terminal of the operational amplifier 270 is connected thereto with an input terminal of an inverter 275. An output terminal of the inverter 275 is connected to the inverting input terminal of the operational amplifier 270 through a resistor 276, and further, grounded through a resistor 272. The output terminal of the operational amplifier 270 is connected to the inverting input terminal of the second operational amplifier 260 through a capacitor 278 and a diode 279. The connected point between the capacitor 278 and the diode 279 is grounded through a resistor 280. Furthermore, the connected point between the capacitor 278 and the resistor 277 is connected to the power source input terminal 290 through a resistor 281. Designated at 291 is a grounding terminal.

Description will now be given of action of the temperature discriminating circuit 25 of the above-described arrangement. The input terminals 251 and 255 are connected to an input and output terminals of the resistor 23, respectively. When the key switch 17 is closed, current starts to flow to the capacitor 274 from the power source input terminal 290 through the resistor 273. At this time, an output from the operational amplifier 270 comes to be on the low level. A voltage divided by the resistors 281 and 277 is applied to one of the terminals of the capacitor 278. On the other hand, a voltage divided by the resistors 266 and 261 is applied to the other of the terminals of the capacitor 278 through the diode 279. Since the voltage division ratio between the resistors 281 and 277 is set at a value larger than the voltage division ratio between the resistors 266 and 261, current flows in the forward direction of the diode 279. This causes a potential at the non-inverting input terminal of the operational amplifier 260 to rise. When this potential exceeds a potential at the output terminal of the operational amplifier 252, an output from the operational amplifier 260 comes to be on the low level. When the output from the operational amplifier 260 comes to be on the low level, current flows into the operational amplifier 260 through the resistor 273, passing through the resistor 269 and the diode 268, whereby the potential of the capacitor 274 is fixed to a low voltage determined by the resistors 273 and 269. In consequence, the output from the output terminal of the operational amplifier 270 remains on the low level.

While the temperature of the glow plug 21 is low and current of a comparatively high value flows, voltage between the opposite ends of the resistor 23, i.e., a potential difference between the first and second input terminals 251 and 255 of the temperature discriminating circuit 25 becomes comparatively high. Thus, an output from the operational amplifier 252 is close to the low level or lower than the voltage determined by the resistors 266 and 261, so that the output from the operational amplifier 260 can be maintained in the low level condition. When the temperature of the glow plug 21 is raised and current is reduced in value, the voltage drop in the resistor 23 is reduced, so that the potential difference between the input terminals 251 and 255 is decreased. When the temperature of the glow plug 21 is lowered to a predetermined value, that is, the voltage drop across the resistor 23 is reduced to a predetermined value, an output voltage from the operational amplifier 252 is raised. When this output voltage exceeds the potential at the inverting input terminal of the operational amplifier 260 determined by the resistors 266 and 261, the output from the operational amplifier 260 is inverted to the high level.

When the output from the operational amplifier 260 comes to be on the high level, current flows through the resistor 273 to the capacitor 274, which will be charged. If the capacitor 274 is charged for a predetermined period of time and the charged potential exceeds the potential at the inverting input terminal of the operational amplifier 270, then the output from the operational amplifier 270 is inverted to the high level. At this time, the capacitor 278 is connected to the power source input terminal 290 through the resistor 273, operational amplifier 270 and resistor 277 in addition to the resistor 281, whereby the potential of the capacitor 278 is further raised. In consequence, current flows to the operational amplifier 260 through the capacitor 278 and diode 279 and the potential at the inverting input terminal of the operational amplifier 260 is raised, whereby the output from the operational amplifier 260 is inverted again to the low level. In other words, a low level signal appears at the output terminal 267 of the temperature discriminating circuit 25.

When the output from the operational amplifier 260 is inverted, an electric charge of the capacitor 274 is discharged through the resistor 269 and diode 268, whereby the charging potential of the capacitor 274 is lowered. In consequence, the output from the operational amplifier 270 is inverted to the low level, whereby one of the terminals of the capacitor 278, which is connected to the resistor 281, has a value divided by the resistors 281 and 277 again.

The diode 265, resistors 262, 264 and transistor 263 are adapted to provide the action of the operational amplifier 260 with a hysteresis to conduct the temperature detection in a stable manner. The inverter 275 and resistor 276 are adapted to provide the action of the operational amplifier 270 with a hysteresis to conduct the timing detection in a stable manner.

Figure 4:
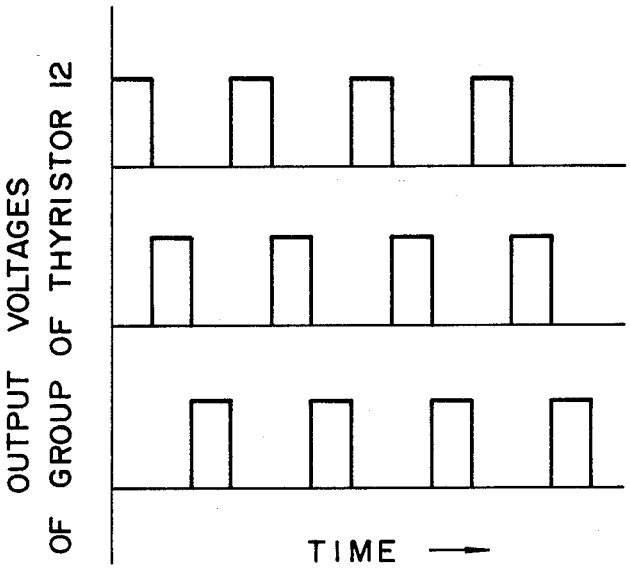
FIG. 4 is a waveform diagram showing the output voltages emitted from the group of thyristors 12.

In the foregoing, three thyristors connected to rectifier circuits of an alternator have been provided for the respective phases. However, as shown in FIG. 4, since each of the thyristors can rectify the three phase alternating currents and the transistor 59 repeats the conducted state or non-conductive state a single thyristor can perform the function similar to the above depending on the characteristics of the glow plug 21.

Further, the after glow current supply has been adapted to be stopped by use of the timing circuit, however, the engine cooling water temperature may be detected to control the after glow current supply only when the engine is in the cold state. Furthermore, in the foregoing, the three phase AC voltages from the alternator have been intermittently applied to the glow plug through the thyristors, however, DC voltages from a generator may be intermittently supplied to the glow plug through the thyristors or transistors.

What is claimed is:

1. A glow plug current supply control system in a diesel engine with a battery and an AC generator driven by said engine, comprising:

a rapid heating circuit for supplying current to a glow plug through a first switching element interposed between a key switch connected through a resistor with a low resistance value to said battery and said glow plug;

an after glow circuit for supplying current to said glow plug through at least one thyristor from an AC generator after starting said engine, wherein the anode of said thyristor is connected to an output terminal of said AC generator and the cathode of said thyristor is connected to said glow plug;

a first on-off control means for continuously closing said first switching element prior to the start of the diesel engine and continuously opening said first switching element after the start of the diesel engine owing to the generated voltage of the AC generator being higher than that of said battery; and a second on-off control means including a circuit with an oscillator having an output connected to a gate terminal of said thyristor, for feeding a periodic signal to said gate terminal from said oscillator so as to periodically turn on-off said thyristor so that the voltage supplied to said glow plug is higher than that of said battery.

2. A glow plug current supply control system in a diesel engine according to claim 1, comprising:

a temperature discriminating circuit for discriminating a temperature of said glow plug by means of sensing a current flow of said resistor connected to said battery and controlling said first control means before the start of said diesel engine such that the temperature of said glow plug is maintained within a predetermined range.

3. A glow plug current supply control system according to claim 1, comprising:

a timing circuit actuated in response to turning on of said key switch, whereby an after glow current supply from said after glow circuit is terminated after a predetermined time.

4. A glow plug current supply control system according to claim 1, wherein said first switching element comprises a relay contact, said first on-off control means including a relay coil, said relay contact adapted to be closed when said relay coil is excited.

5. A glow plug current supply control system according to claim 1, wherein said thristor is a single one provided in common with all three phases of said AC generator.

* * * * *